US009033550B1

(12) United States Patent
Tickner

(10) Patent No.: US 9,033,550 B1
(45) Date of Patent: May 19, 2015

(54) ACCESSIBLE DRIVERS AND CABLING SYSTEMS FOR LIGHT EMITTING DIODE FIXTURES

(71) Applicant: Jerold Alan Tickner, Newnan, GA (US)

(72) Inventor: Jerold Alan Tickner, Newnan, GA (US)

(73) Assignee: Cooper Technologies Company, Houston, TX (US)

( * ) Notice: Subject to any disclaimer, the term of this patent is extended or adjusted under 35 U.S.C. 154(b) by 132 days.

(21) Appl. No.: 13/941,245

(22) Filed: Jul. 12, 2013

Related U.S. Application Data

(60) Provisional application No. 61/673,502, filed on Jul. 19, 2012.

(51) Int. Cl.

| | |
|---|---|
| ***F21V 19/02*** | (2006.01) |
| ***F21V 21/14*** | (2006.01) |
| ***F21V 27/00*** | (2006.01) |
| *F21V 21/04* | (2006.01) |

(52) U.S. Cl.
CPC ..... *F21V 21/14* (2013.01); *F21V 27/00* (2013.01); *F21V 21/04* (2013.01)

(58) Field of Classification Search
CPC ..... F21V 27/00; F21V 21/14; F21V 21/30
USPC ..... 362/364, 365, 285
See application file for complete search history.

(56) References Cited

U.S. PATENT DOCUMENTS

| | | | | |
|---|---|---|---|---|
| 6,517,222 | B1 * | 2/2003 | Orlov | 362/391 |
| 2013/0155702 | A1 * | 6/2013 | Rea et al. | 362/391 |
| 2014/0268799 | A1 * | 9/2014 | Stolte et al. | 362/294 |

* cited by examiner

*Primary Examiner* — Evan Dzierzynski
(74) *Attorney, Agent, or Firm* — King & Spalding LLP

(57) ABSTRACT

A light emitting diode (LED) lighting fixture can include a LED driver housing that includes an opening, and a LED driver positioned within the LED driver housing. The LED lighting fixture can also include a mounting assembly. The mounting assembly of the LED lighting fixture can include a frame removably coupled to the LED driver housing around the opening. The mounting assembly of the LED lighting fixture can also include a bracket movably coupled to the frame and positioned over the opening, where the bracket comprises a plurality of fastening devices that, when loosened, allow the bracket to move from a closed position to an open position, where more of the opening is exposed when the bracket is in the open position than when the bracket is in the closed position.

20 Claims, 7 Drawing Sheets

ACCESSIBLE DRIVERS AND CABLING SYSTEMS FOR LIGHT EMITTING DIODE FIXTURES

CROSS-REFERENCE TO RELATED APPLICATIONS

This application claims priority under 35 U.S.C. §119 to U.S. Provisional Patent Application Ser. No. 61/673,502, titled "Accessible Driver and Cabling System for Light Emitting Diode Fixture" and filed on Jul. 19, 2012, the entire contents of which are hereby incorporated herein by reference.

TECHNICAL FIELD

Embodiments described herein relate generally to light emitting diode (LED) fixtures, and more particularly to systems, methods, and devices for accessing LED drivers in LED lighting fixtures and cabling systems for LED lighting fixtures.

BACKGROUND

On occasion, a LED driver of a LED lighting fixture requires maintenance and/or repair. In some applications, accessing a LED driver in a LED lighting fixture requires additional people, tools, material, time, and expense. In such cases, some or all of the LED lighting fixture is disassembled and/or dismounted in order to access the LED driver.

In addition, cables in a pendant or drop-down LED lighting fixture are used to suspend the LED lighting fixture in addition to supplying power and/or control to the LED lighting fixture. In such cases, only a single cable is used for a single hanger. Because the LED lighting fixture operates on direct current (DC) power, each cable provides either a positive DC feed or a negative DC feed to the LED lighting fixture. To qualify as a Class 2 fixture, a single cable feeding a LED lighting fixture must be under 60 Volts and less than 100 watts. Thus, cable-hung LED lighting fixtures have certain design and performance limitations.

SUMMARY

In general, in one aspect, the disclosure relates to a LED lighting fixture. The LED lighting fixture can include a LED driver housing having an opening, and a LED driver positioned within the LED driver housing. The LED lighting fixture can also include a mounting assembly. The mounting assembly of the LED lighting fixture can include a frame removably coupled to the LED driver housing around the opening. The mounting assembly of the LED lighting fixture can also include a bracket movably coupled to the frame and positioned over the opening, where the bracket includes a number of fastening devices that, when loosened, allow the bracket to move from a closed position to an open position, where more of the opening is exposed when the bracket is in the open position than when the bracket is in the closed position.

In another aspect, the disclosure can generally relate to a method for accessing a LED driver within a LED driver housing. The method can include loosening at least one fastening device of a number of fastening devices, where each of the fastening devices traverses a bracket and is mechanically coupled to the frame, where the frame is coupled to the LED driver housing and is positioned over an opening in the LED driver housing. The method can also include moving the bracket from a closed position to an open position. The method can further include accessing the LED driver through the opening exposed when the bracket is in the open position.

In another aspect, the disclosure can generally relate to a cabling system for a LED lighting fixture. The cabling system can include a LED driver housing, and a LED driver disposed within the LED driver housing. The cabling system can also include a first wire having a first conductor carrying a positive power component from the LED driver, where the first wire is electrically coupled to the LED driver. The cabling system can further include a second wire having a second conductor carrying a negative power component from the LED driver, where the second wire is electrically coupled to the LED driver. The cabling system can also include a remainder of the LED lighting fixture that is electrically coupled to the first wire and the second wire, where the remainder includes at least one LED that operates using the positive power component carried by the first wire and the negative power component carried by the second wire. The cabling system can further include a first coupling feature positioned between the LED driver housing and the remainder of the LED lighting fixture, where the first coupling feature is mechanically coupled to the first wire and the second wire, where the first coupling feature maintains a physical separation between the first wire and the second wire.

These and other aspects, objects, features, and embodiments will be apparent from the following description and the appended claims.

BRIEF DESCRIPTION OF THE DRAWINGS

The drawings illustrate only example embodiments of methods, systems, and devices associated with accessible drivers and cabling systems for LED fixtures, and are therefore not to be considered limiting of its scope, as accessible drivers and cabling systems for LED fixtures may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
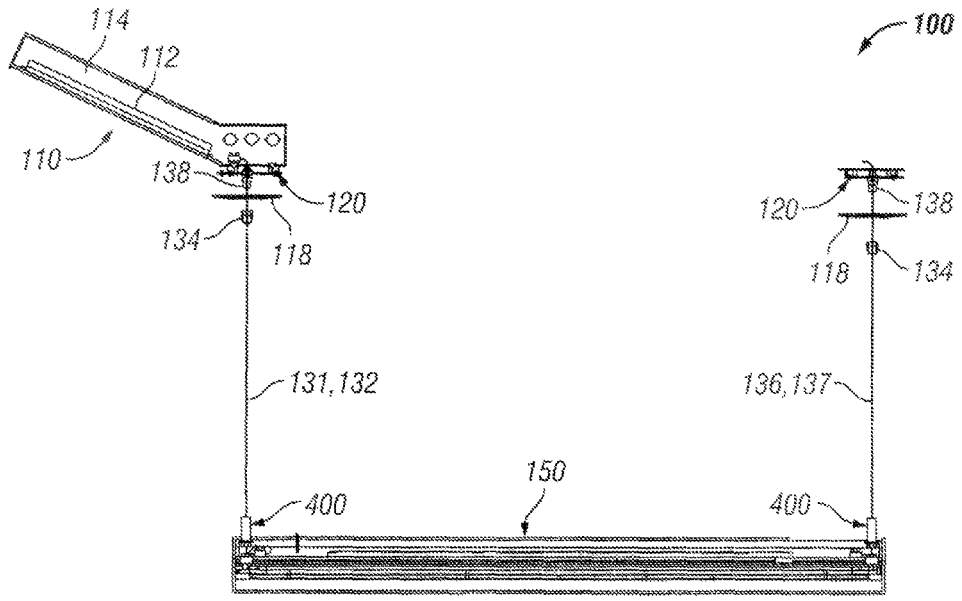
FIGS. 1A-1C show various views of an example LED lighting fixture in accordance with certain example embodiments.

The example embodiments discussed herein are directed to systems, apparatuses, and methods of accessing LED drivers in LED lighting fixtures and cabling systems for LED lighting fixtures. In one or more example embodiments, an LED lighting fixture (which may also be called a LED light fixture or a LED fixture) meets one or more of a number of standards, codes, regulations, and/or other requirements established and maintained by one or more entities. Examples of such entities include, but are not limited to, Underwriters' Laboratories, the Institute of Electrical and Electronics Engineers, and the National Fire Protection Association. For example, wiring (the wire itself and/or the installation of such wire) that electrically couples a LED driver of a LED lighting fixture to a remainder of the LED lighting fixture that is hung may fall within one or more standards set forth in the National Electric Code (NEC). Specifically, Article 725 of the NEC defines, among other circuits, Class 1 circuits and Class 2 circuits.

Class 1 circuits under Article 725 of the NEC typically operate between 120 V alternating current (AC) and 600 VAC. The wiring used for Class 1 circuits under Article 725 of the NEC must be run in raceways, conduit, and enclosures for splices and terminations. Consequently, wiring for Class 1 circuits must be installed by a licensed electrical professional.

By contrast, Class 2 circuits, under Article 725 of the NEC typically operate at lower power levels (e.g., up to 100 VA, no more than 30 VAC). The wiring used for Class 2 circuits under Article 725 of the NEC does not need to be run in raceways, conduit, and/or enclosures for splices and terminations. Consequently, wiring for Class 2 circuits does not need to be installed by a licensed electrical professional.

Example LED lighting fixtures can be of any size and/or shape, and can have any number of LEDs. Such LED lighting fixtures can be located indoors and/or outdoors and can be mounted to a surface (e.g., wall, ceiling, pillar), be part of a lamp, or be used with any other suitable mounting instrument. In certain example embodiments, the LED driver of the LED lighting fixture is mounted on one side of a wall or ceiling, while the remainder of the LED lighting fixture is positioned on the other side of the wall or ceiling. When the LED lighting fixture is mounted with respect to a ceiling, the LED driver can be mechanically coupled to the remainder of the LED lighting fixture using one or more cables that provide DC power from the LED driver to the remainder of the LED lighting fixture. Such LED lighting fixtures can be used in residential, commercial, and/or industrial applications. Such LED lighting fixtures can operate from a manual fixture (e.g., on/off switch, dimming switch, pull chain), a photocell, a timer, and/or any other suitable mechanism.

The example LED lighting fixtures described herein have one or more of a number of components. One such component of certain example LED lighting fixtures is a LED driver housing. The LED driver housing can include one or more other components, including but not limited to a LED driver, a heat sink, and an adapter. The components of the LED driver housing can be integrated into a single unit or can be one or more separate pieces that electrically and/or mechanically couple together to form a single unit.

The LED driver can include one or more of a number of components (e.g., transformer, resistor, capacitor, integrated circuit) that can be discrete components, components integrated with a circuit board, and/or functions performed by components that are programmed into a hardware processor. The power source that feeds a LED driver of a LED lighting fixture can provide one or more of a number (and/or a range) of voltages, including but not limited to 120 V alternating current (AC), 110 VAC, 240 VAC, 24 V direct current (DC), and 0-10 VDC. The LED driver receives power and/or control information (signals) from the power source (or a switch or control device communicably coupled to the LED driver) of the existing fixture, converts the power and/or control to a corresponding signal (e.g., voltage, current), and sends the corresponding signal to the LEDs to control the operational characteristics of the LEDs. In certain example embodiments, the signal sent by the LED driver is DC.

The one or more LEDs of the LED lighting fixture can use any type of technology, including but not limited to, discrete LEDs, LED arrays, chip-on-board LEDs, edge lit LED panels, and surface mounted LEDs. The LEDs can emit light in one or more colors. The LEDs can also be of any shape, size, and brightness.

A heat sink of the LED lighting fixture is thermally coupled to the LEDs and/or the LED driver and dissipates heat generated by the LEDs and/or LED driver. A heat sink can include one or more features (e.g., fins, fans, synthetic jets) for active or passive cooling of the LED lighting fixture. The heat sink can be made from one or more of a number of suitable materials, including but not limited to metal, plastic, and ceramic.

When the LED driver is accessed using example embodiments described herein, safety precautions (e.g., unplugging the device, shutting off power to the circuit that feeds the device) should be followed to ensure that a person performing work on the exposed wiring and other components of the LED lighting fixture avoids the risk of shock and other electrical hazards. As used herein with respect to the LED driver positioned within a LED driver housing, words such as "accessed," "access," and "accessing" are used to describe the ability to maintain the LED driver within and/or remove the LED driver from the LED driver housing.

Example embodiments for accessing LED drivers in LED lighting fixtures and cabling systems for LED lighting fixtures will be described more fully hereinafter with reference to the accompanying drawings, in which example embodiments of accessing LED drivers in LED lighting fixtures and cabling systems for LED lighting fixtures are shown. Accessing LED drivers in LED lighting fixtures and cabling systems for LED lighting fixtures may, however, be embodied in many different forms and should not be construed as limited to the example embodiments set forth herein. Rather, these example embodiments are provided so that this disclosure will be thorough and complete, and will fully convey the scope of accessing LED drivers in LED lighting fixtures and cabling systems for LED lighting fixtures to those or ordinary skill in the art. Like, but not necessarily the same, elements (also sometimes called components) in the various figures are denoted by like reference numerals for consistency.

Figure 1B:
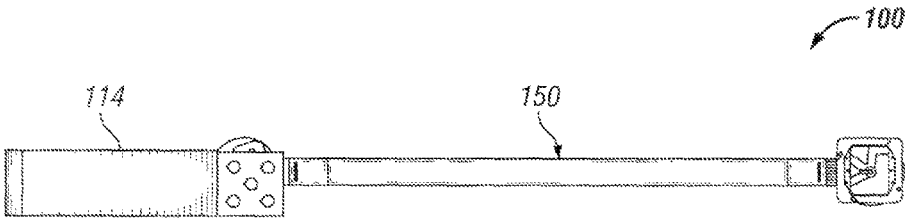
Figure 1C:
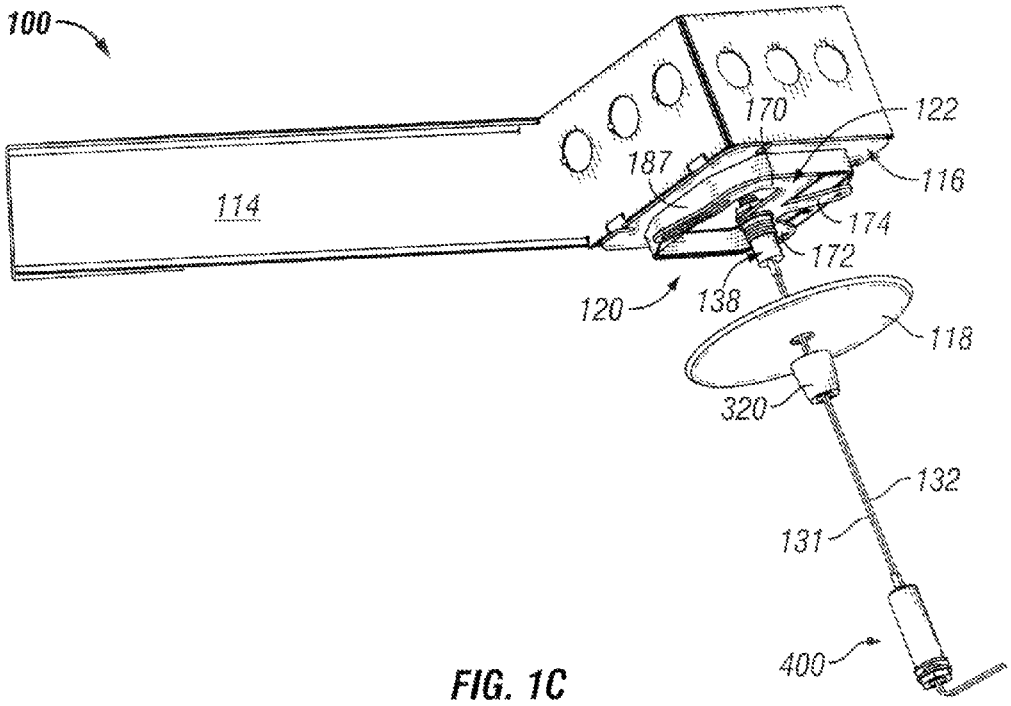

FIGS. 1A-1C show various views of an example LED lighting fixture 100 in accordance with certain example embodiments. Specifically, FIG. 1A shows a cross-sectional side view of the LED lighting fixture 100. FIG. 1B shows a top view of the LED lighting fixture 100, and FIG. 1C shows a bottom perspective view of the LED lighting fixture 100. In one or more embodiments, one or more of the features shown in FIG. 1 may be omitted, added, repeated, and/or substituted. Accordingly, embodiments of a LED lighting fixture should not be considered limited to the specific arrangements of components shown in FIG. 1.

Referring to FIGS. 1A-C, the LED lighting fixture 100 can include a LED driver housing 114 that houses a LED driver 112. The LED driver housing 114 and LED driver 112 in this example are mounted above a ceiling (not shown). The ceiling can be tile, drywall, brick, concrete, some other suitable material, or any combination thereof. In addition to the LED driver housing 114 and LED driver 112, one or more mounting assemblies 120 can be used above the ceiling 118. The mounting assemblies 120 are described in more detail below with respect to FIGS. 2A-2D. As shown in FIG. 1A, a mounting assembly 120 can be mechanically coupled to the LED driver housing 114 or can be physically separated from the LED driver housing 114.

In alternative example embodiments, the ceiling can be located between the mounting assembly 120 and the cover plate 118 shown in FIGS. 1A-1C. In such a case, the cover plate 118 can be mechanically coupled to the underside of the ceiling and held in place by a cap 134 of the coupling feature 138. Further, in such a case, the coupling feature 138 can traverse an aperture in the ceiling. In yet another alternative example embodiment, the mounting assembly 120 traverses an aperture in the ceiling. In such a case, the cover plate 118 can be shaped and sized in such a way as to rest flush against the bottom side of the ceiling and hide or obscure the mounting assembly 120 and the coupling feature 138 from view.

In certain example embodiments, multiple cables 131, 132, 136, 137 are used to hang a remainder 150 of the LED lighting fixture 100. Each cable 131, 132, 136, 137 traverses an aperture in the ceiling 118. One end of a cable 131, 132, 136, 137 can be mechanically coupled to a mounting assembly 120. The mechanical coupling of a cable 131, 132, 136, 137 to the mounting assembly 120 can be performed using a coupling feature 138, which is described in more detail below with respect to FIG. 3. The other end of a cable 131, 132, 136, 137 can be mechanically coupled to the remainder 150 of the LED lighting fixture 100. The mechanical coupling of a cable 131, 132, 136, 137 to the remainder 150 of the LED lighting fixture 100 can be performed using an alternative example coupling feature 400, which is described in more detail below with respect to FIGS. 4A and 4B.

Each cable 131, 132, 136, 137 can be electrically, and in some cases physically, separated from the other cables. As described above, each cable 131, 132, 136, 137 can carry either a positive DC feed or a negative DC feed, which necessitates the need to keep each of the cables separated. If a positive DC feed and a negative DC feed make contact, an undesired electrical condition (e.g., short circuit, explosion, fire) can occur, damaging the LED lighting fixture 100 and the surrounding environment. In certain example embodiments, each cable 131, 132, 136, 137 is coated with an electrically non-conductive material (e.g., rubber, plastic) that keeps the one or more conductors inside each cable 131, 132, 136, 137 isolated from any metal or other electrically conductive surface.

Figure 2A:
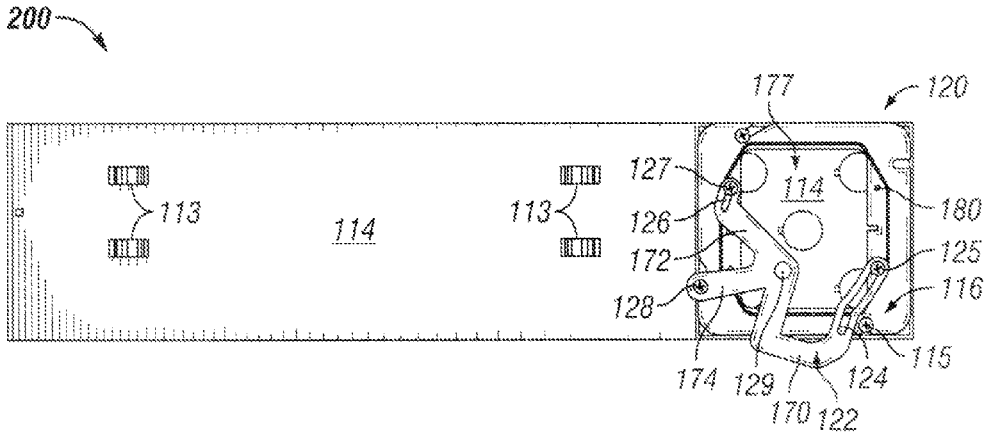
FIGS. 2A-2D show various views of an example LED driver access feature of a LED lighting fixture in accordance with certain example embodiments.
Figure 2B:
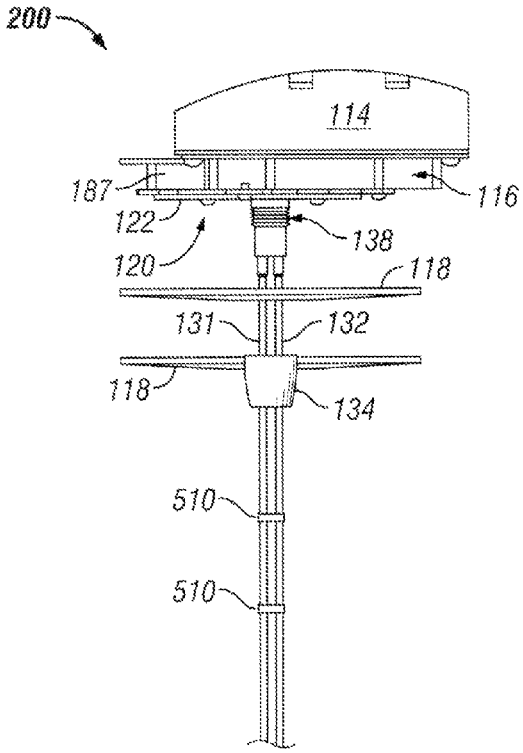
Figure 2C:
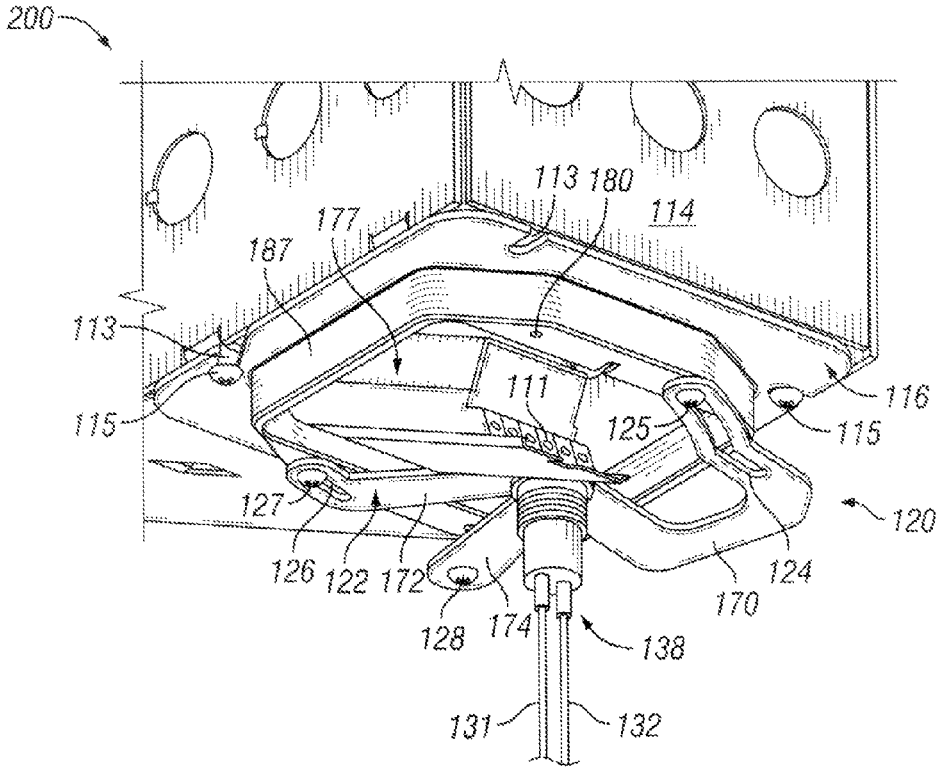
Figure 2D:
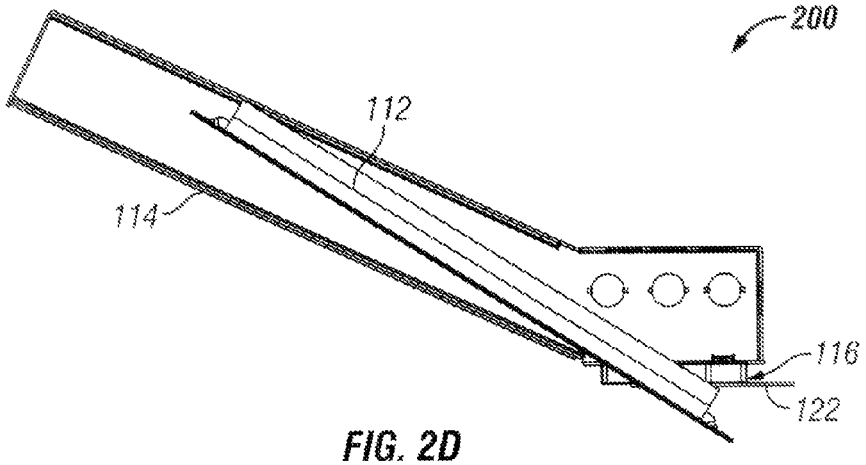

FIGS. 2A-2D show various views of an example LED driver access feature (in this case, the example mounting assembly 120) of a LED lighting fixture 200 in accordance with certain example embodiments. Specifically, FIG. 2A shows a bottom view of a portion of the LED lighting fixture 200 that includes a mounting assembly 120 mounted to a LED driver housing 114. FIG. 2B shows a side view of a portion of the LED lighting fixture 200 that includes the mounting assembly 120 mounted to the LED driver housing 114, two cables 131, 132, a coupling feature 138 and cap 124, and a cover plate 118. FIG. 2C shows a bottom perspective view of the example mounting assembly 120. FIG. 2D shows a cross-sectional side view of the LED driver housing 114 with LED driver 112 being removed using the example mounting assembly 120. In one or more embodiments, one or more of the features shown in FIG. 1 may be omitted, added, repeated, and/or substituted. Accordingly, embodiments of a LED lighting fixture should not be considered limited to the specific arrangements of components shown in FIG. 1.

Referring to FIGS. 1A-2D, the example mounting assembly 120 includes a bracket 122 and a frame 116. The bracket 122 and frame 116 are mechanically coupled to, and cover an opening 177 to, the LED driver housing 114. Through this opening 177 in the LED driver housing 114, the LED driver 112 can be accessed. The frame 116 covers the outer perimeter of the opening 177 in the LED driver housing 114, while the bracket 122 covers at least part of the middle portion of the opening 177 in the LED driver housing 114. If the bracket 122 is moved (e.g., rotated), then enough of the opening 177 in the LED driver housing 114 can be exposed to access the LED driver 112 inside the LED driver housing 114. In such a case, the LED fixture 200 would not need to be fully or partially dismantled to access the LED driver 112 inside the LED driver housing 114.

In certain example embodiments, the bracket 122 of the mounting assembly 120 includes a number of features. For example, as shown in FIGS. 2A and 2C, the bracket 122 can include three extensions that each has an aperture or other fastening feature. In this case, the longest extension 170 is U-shaped and has a slot 124 that traverses most of the distal end of the extension 170. The slot 124 can have a width and thickness that allows the slot 124 to receive a fastening device 125 (e.g., screw, bolt, clip). The shortest extension 174 in this example is straight and has, at its end, a single aperture (hidden from view) for receiving a fastening device 128. The other extension 172 is angled and has a slot 126 that traverses most of the angled portion. The slot 126 can have a width and thickness that allows the slot 126 to receive a fastening device 127. In such a case, the fastening device 125, the fastening device 127, and the fastening device 128 can also mechanically couple to one or more corresponding fastening features (e.g., apertures) (hidden from view) disposed on the frame 116.

By removing the fastening device 128 from the aperture in the shortest extension 174 of the example bracket 122 and/or from the corresponding fastening feature in the frame 116, the bracket 122 can slide and rotate along the apertures 124 and 126 by loosening fastening devices 125 and 127. In so doing, the opening 177 can become large enough that the LED driver 112 in the LED driver housing 114 can be accessed through the opening 177. The view in FIG. 2D shows the bracket 122 in the "closed" position (i.e., the position of the bracket 122 makes the opening 177 in the LED driver housing 114 too small, making the LED driver 112 inaccessible), while the views in FIGS. 2A and 2C show the bracket in the "open" position (i.e., the position of the bracket 122 makes the opening 177 large enough to access the LED driver 112 in the LED driver housing 114). In certain example embodiments, when the example bracket 122 is moved between the closed and open positions, the wiring for the LED lighting device 200 remains connected, as when the LED lighting fixture 100 is operating.

Figure 6A:
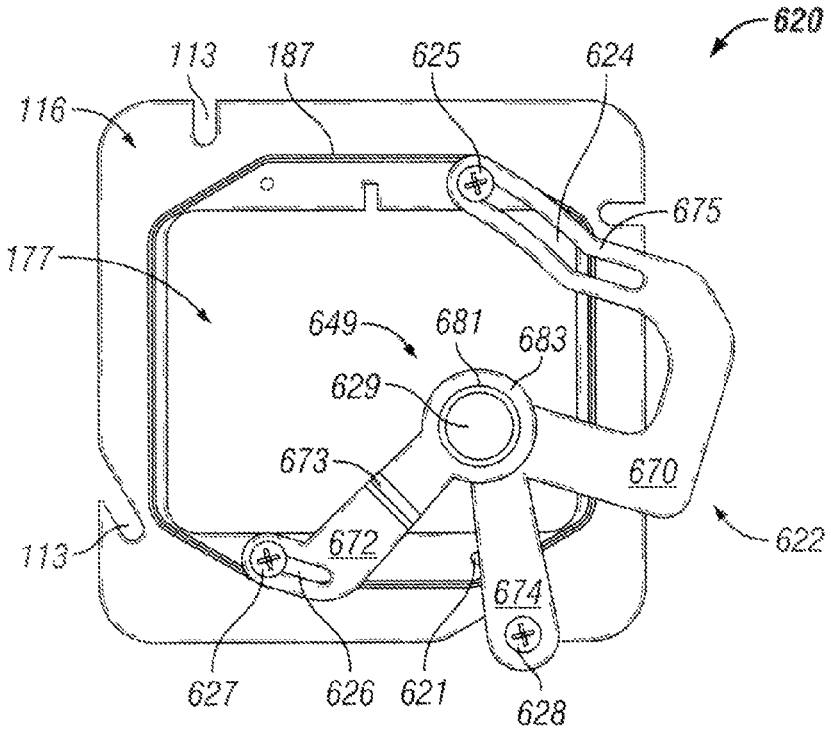
FIGS. 6A and 6B show various views of an example bracket of a mounting assembly in accordance with certain example embodiments.
Figure 6B:
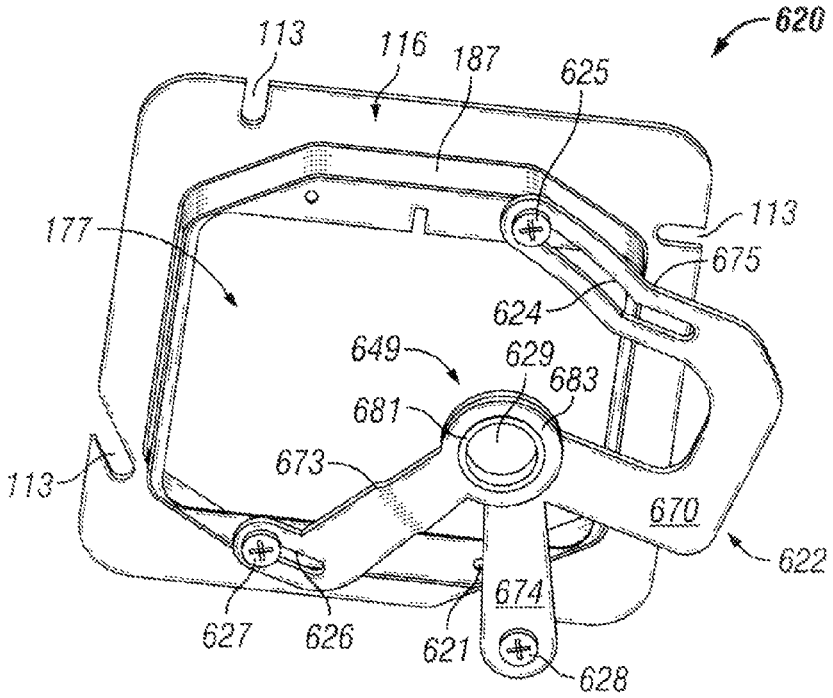

In addition, or in the alternative, the example bracket 122 can be maneuvered in one or more of another of ways. For example, as shown in FIGS. 6A and 6B below, one or more extensions of the bracket can be hinged in one or more places, allowing one or more portions of the bracket to move relative to other portions of the bracket and allow access to the LED driver housing 114. As another example, portions of the bracket 122 may slide (as with detents) along other portions of the bracket 122. In such a case, when a fastening device (e.g., fastening device 128) is loosened or removed, a portion of the bracket 122 may slide to expose an opening to the LED driver housing 114.

Further, the features (e.g., number of extensions, shape of an extension, size of an extension, location and/or size of apertures) of the bracket 122 can vary based on one or more of a number of factors (e.g., amount of slack in the cables 131, 132, size and/or weight of the remainder 150 of the LED lighting fixture 100, the size of the LED driver 112, the size of the opening 117). Such features, whether used separately or in combination, can also allow the bracket 122 to be moved (rotated, slid, etc.) into an open position to provide access to the LED driver 112 through the opening in the LED driver housing 114.

The frame 116 can have one or more receiving apertures 113 (e.g., slots, holes) through which one or more of a number of fastening devices 115 (e.g., screw, bolt, clip) can traverse and anchor to a portion of the LED driver housing 114. In so doing, the fastening devices 115 secure (mechanically couple) the frame 116 to the LED driver housing 114. The frame 116 can have one or more of a number of other features, such as the raised portion 187 shown in FIGS. 2A-2D. The raised portion 187 of the frame 116 can include a number of other receiving apertures 180 through which the fastening devices 125, 127, 128 traverse to secure the bracket 122 to the frame 116. In certain example embodiments, the frame 116, with or without the raised portion 187, has an opening large enough to allow access to the LED driver 112. The bracket 122 and frame 116 can be made of one or more of a number of suitable materials (e.g., metal, plastic, rubber, ceramic).

In certain example embodiments, the bracket 122 also includes a central aperture 129 through which a coupling feature 138 and/or one or more wires 131, 132 traverse. One end of the wires 131, 132 can terminate at a termination point (e.g., terminal block 111) within the LED driver housing 114, while the other end of the wires 131, 132 can terminate at the remainder 150 of the LED lighting fixture 100. The wires 131, 132 can also traverse the coupling feature 138, which can be mechanically (e.g., threadably, slidably) coupled to the central aperture 129. In certain example embodiments, the central aperture 129 in the bracket 122 has one or more features (e.g., threads) that allow the coupling feature 138 to be mechanically coupled to the bracket 122. The coupling feature 138 is described in more detail below with respect to FIG. 3.

Figure 3:
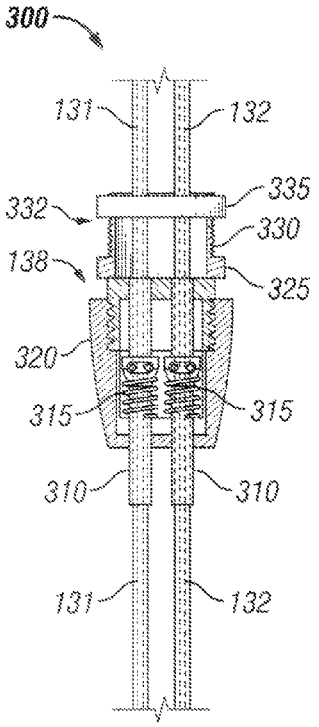
FIG. 3 shows an example coupling feature for cable hangers of a LED lighting fixture in accordance with certain example embodiments.

As discussed above, it is important to keep the wires 131 and 132 physically separated along the entire length of wires 131 and 132 to avoid an electrical fault. FIGS. 3-5 show various example devices that can be used keep the wires 131 and 132 physically separated along different portions of the wires 131 and 132 in accordance with certain example embodiments. For example, FIG. 3 shows a partially transparent cross-sectional side view of a portion 300 of a LED lighting fixture that includes an example coupling feature 138 for cable hangers of a LED lighting fixture in accordance with certain example embodiments. In one or more embodiments, one or more of the features shown in FIGS. 3-5 may be omitted, added, repeated, and/or substituted. Accordingly, embodiments of devices for physically separate wires for a LED lighting fixture should not be considered limited to the specific arrangements of components shown in FIGS. 3-5.

Referring to FIGS. 1-3, the example coupling feature 138 of FIG. 3 includes a top securing portion 332, a housing 320, and a bottom portion 315. The top securing portion 332 shown in FIG. 3 includes a base 335 at the top and a threaded body 330 that extends downward from the base 335. In certain example embodiments, the threaded body 330 extends through and is threadably coupled to the central aperture 129 in the bracket 122, while the base 335 rests upon a top surface of the bracket 122 when the threaded body 330 is driven far enough through the central aperture 129 in the bracket 122. In certain example embodiments, the threaded body 330 is smooth and/or has other features (e.g., slots, holes, tabs) that can be used to secure the top securing portion 332 and/or some other portion of the securing member 138 to the bracket 122 and/or other portions of the LED lighting fixture 100.

An optional nut 325 can have a threaded inner surface that allows the nut 325 to threadably couple to the bottom portion of the threaded body 330. In certain example embodiments, the nut 325 is driven toward the base 335 until the top of the nut 325 rests on a bottom surface of the bracket 122. In addition, or in the alternative, the nut 325 can have one or more other features, shapes, and functions to help secure the top securing portion 332 and/or some other portion of the securing member 138 to the bracket 122 and/or other portions of the LED lighting fixture 100. For example, the nut 325 can be a clamp that fits within one or more slots in the threaded body 330 to mechanically couple to a portion of the threaded body 330.

In certain example embodiments, the top securing portion 332 also includes at least one aperture for each wire 131, 132. Each aperture is large enough to allow the wire 131, 132 to pass therethrough. Each aperture in the top securing portion 332 can be spaced far enough away from the other apertures in the top securing portion 332 so that the wires 131, 132 do not physically make contact with each other (and, in some cases, have a minimum clearance distance between wires) within the top securing portion 332. In alternative example embodiments, the top securing portion 332 includes one or more features that allow the top securing portion 332 to mechanically couple to the bracket 122 and/or some other component of the LED lighting fixture 100.

In certain example embodiments, the bottom portion 315 is part of a single piece that includes the top securing portion 332. Alternatively, the bottom portion 315 can be mechanically coupled to the threaded body 330 of the top securing portion 332. The bottom portion 315, like the top securing portion 332, can have at least one aperture for each wire 131, 132. In such a case, each aperture is large enough to allow the wire 131, 132 to pass therethrough. Each aperture in the bottom portion 315 can be spaced far enough away from the other apertures in the bottom portion 315 so that the wires 131, 132 do not physically make contact with each other (and, in some cases, have a minimum clearance distance between wires) within the bottom portion 315.

The bottom portion 315 can also include one or more other features. For example, each aperture in the bottom portion 315 can include a spring-loaded feature for gripping and securing a wire (e.g., wire 131, wire 132) that passes therethrough. As another example, the bottom portion 315 can include a feature that allows the length of the bottom portion 315 to be adjusted.

The coupling feature 138 can also include one or more other features aside from those mentioned above. For example, cable gripper plungers 310 can be used to cover (as in a sleeve, for example) at least a portion of the wire 131, 132. The cable gripper plungers 310 can be made of one or more of a number of electrically non-conductive materials, including but not limited to rubber, plastic, and ceramic. The cable gripper plungers 310 can extend from outside the bottom portion 315 of the coupling feature 138 to inside the bottom portion 315 of the coupling feature 138. In such a case, the cable gripper plungers 310 can allow a spring-loaded feature (or some other attachment feature) in the bottom portion 315 that is used for gripping and securing the wire 131, 132 to function without compromising the insulation of the wire 131, 132. In other words, the cable gripper plungers 310 can provide extra protection for the conductors within the wire 131, 132.

In certain example embodiments, the housing 320 is disposed over at least a portion of the bottom portion 315 and/or the top securing portion 332 of the coupling feature 138. The housing can be removably coupled to the bottom portion 315 and/or the top securing portion 332 using one or more of a number of coupling features. Examples of such coupling features can include, but are not limited to, mating threads, snap fittings, clips, and slotted couplings. The various components of the coupling feature (e.g., the top securing portion 332, the housing 320, the bottom portion 315) can be made from one or more of a number of materials. Such materials can be electrically non-conductive, such as plastic, nylon, or rubber.

Figure 4A:
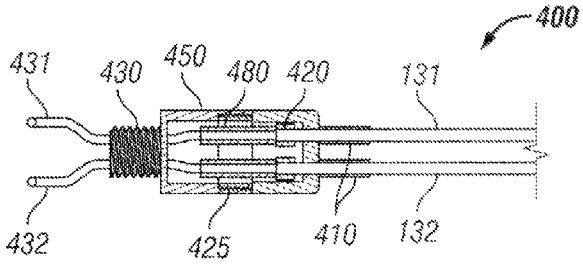
FIGS. 4A and 4B show various views of an example connector for cable hangers of a LED lighting fixture in accordance with certain example embodiments.
Figure 4B:
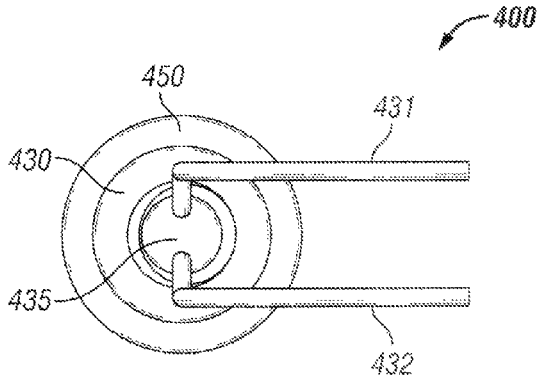
Figure 5:
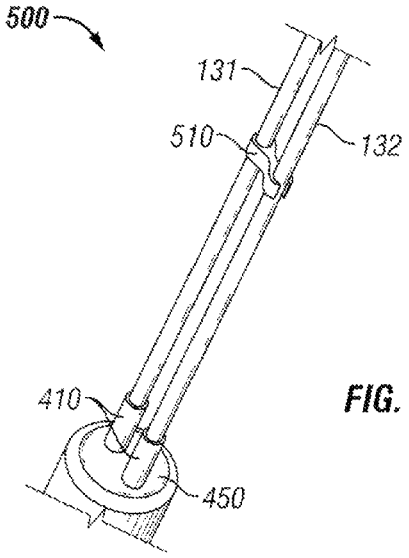
FIG. 5 shows an example cable separating clip in accordance with certain example embodiments.

FIGS. 4A and 4B show an alternative example coupling feature 400 that is used to mechanically couple to the remainder 150 of the LED lighting fixture 100. Referring to FIGS. 1-4B, the coupling feature can include a cover 450, cable gripper plungers 410, and a threaded body 430 that are substantially similar to the corresponding components of the coupling feature 138 described above with respect to FIG. 3. In addition, the body 450 of the coupling feature 400 can include a number of other components. For example, a collar 425 can be positioned inside the body 450 to hold each of the wires 131, 132 in place as each wire 131, 132 passes through the collar 425.

On either side of the collar 425 within the body 450 can be one or more crimps to each wire 131, 132. For example, to the right of the collar 425 in FIG. 4A, each wire 131, 132 has a barrel crimp 420 to hold the wires 131, 132 in place within the body 450. As another example, to the left of the collar 425 in FIG. 4A, each wire 131, 132 has a butt splice crimp 480 that transitions from the wire 131, 132 (including the insulation) to the right of the butt splice crimp 480 to the bare conductors 431, 432 (without the insulation) to the left of the butt splice crimp 480.

Because the bare conductors 431, 432 are exposed to the left of the butt splice crimp 480, even greater care must be taken to ensure that the conductors 431, 432 do not make contact with each other. For example, as shown in FIG. 4B, an insulator 435 can be inserted inside of the threaded body 430. The insulator 435 can be made of one or more of a number of electrically non-conductive (insulating) materials (e.g., plastic, nylon, rubber) to keep the conductors 431, 432 isolated from each other inside the coupling feature 400. The coupling feature 400 can also include one or more other features not shown in FIGS. 4A and 4B, including but not limited to a cover, as with the cover 320 described above with respect to FIG. 3.

FIG. 5 shows a portion 500 of a LED lighting fixture 100 that includes a wire separating clip 510. Referring to FIGS. 1-5, the wire separating clip 510 shown in FIG. 5 can be removably coupled to the wires 131, 132. In certain example embodiments, the wire separating clip 510 is made of a firm or semi-firm material that has each end affixing to a cable. In such a case, the wire separating clip 510 can have a snap fitting at one or both ends for coupling to, and decoupling from, one or more wires. The amount of force applied by the wire separating clip 510 to the wires can be strong enough to prevent the wire separating clip 510 from being movable (slidable) along the wires, or light enough to allow the wire separating clip 510 to be movable (slidable) along the wires while remaining coupled to the wires.

The wire separating clip 510, when mechanically coupled to the wires 131, 132, keeps the wires 131, 132 physically separated from each other. The spacing at which the wire separating clip separates the wires can be the same or different than the spacing at which the coupling feature separates the wires. The wire separating clip 510 can be made of one or more of a number of electrically non-conductive materials, including but not limited to plastic, nylon, fiberglass, and rubber. The wire separating clip 510 can have one or more of a number of shapes. For example, as shown in FIG. 5, the wire separating clip 510 can be shaped like a dog bone.

FIGS. 6A and 6B show various views of an example bracket 622 of a mounting assembly 620 in accordance with certain example embodiments. Specifically, FIG. 6A shows a front (bottom) view of the example mounting assembly 620, and FIG. 6B shows a bottom perspective view of the mounting assembly 620. In one or more embodiments, one or more of the features shown in FIGS. 6A and 6B may be omitted, added, repeated, and/or substituted. Accordingly, embodiments of a bracket of a mounting assembly should not be considered limited to the specific arrangements of components shown in FIGS. 6A and 6B.

The bracket 622 of FIGS. 6A and 6B is substantially similar to the bracket 122 of FIGS. 2A-D, except as described below. One such difference between the bracket 622 and the bracket 122 is that that a hinge 649 is incorporated with the central aperture 629 of the bracket 622. The hinge 649 allows one or more portions (e.g., extension 670, extension 672, extension 674) of the bracket 622 to move (e.g., rotate) with respect to each other. In this example, the extension 670 and the extension 674 form a single piece that is a separate piece from extension 672.

The hinge 649 can be made up of multiple portions. In this example, the hinge 649 is made of an inner portion 681 and an outer portion 683. The single piece formed by the extension 670 and the extension 674 includes the inner portion 681, which is located where the extension 670 and the extension 674 are joined. The outer portion 683 is located on the end of the extension 672 opposite of where the slot 626 is located.

The inner portion 681 and the outer portion 683 of the hinge 649 are each sized and shaped in such a way to allow the various portions of the bracket to movably couple to each other. In this example, the inner portion 681 and the outer portion 683 form concentric circles (cylindrical portions). The inner portion 681 and/or the outer portion 683 can include one or more features (e.g., slots, ridges, collars) that allow the various portions of the bracket 622 to rotate (or otherwise move) with respect to each other while remaining attached to each other.

In order for the various portions of the bracket 622 to move with respect to each other, at least one of the fastening devices (e.g., fastening device 625, fastening device 627, fastening device 628) that mechanically couple the bracket 622 to the frame 116 must be loosened or removed. For example, as shown in FIGS. 6A and 6B, fastening device 628, while still coupled to the extension 674, is removed from the aperture 621 in the bracket 116. Further, fastening device 625 and fastening device 627 are loosened (without being removed from their respective apertures in the bracket 116) to allow the extension 672 to move along slot 626 and to allow extension 670 to move along slot 624. In addition, the portions of the bracket 622 can be further manipulated (such as, for example, by pulling extension 674 away from the bracket 116) to further widen the opening 177.

In certain example embodiments, the example bracket 622 includes one or more of a number of other features to allow for movement between two or more of its portions. For example, as shown in FIGS. 6A and 6B, one of more of the extensions can have a ramp. In this case, extension 670 has a ramp 675 that is positioned along the slot 624, approximately half way along the straight segment at the distal end of the extension 670, and extension 672 has a ramp 673 that is positioned approximately half way along its length. Ramp 675 is configured in such a way as to elevate the proximal end of the extension 670 further away from the bracket 116 relative to the distal end of the extension 670. Similarly, ramp 673 is configured in such a way as to elevate the proximal end of the extension 672 further away from the bracket 116 relative to the distal end of the extension 672. Ramp 673, ramp 675, and/or other similar features can allow a wider range of movement between the various portions of the bracket 622.

Figure 7:
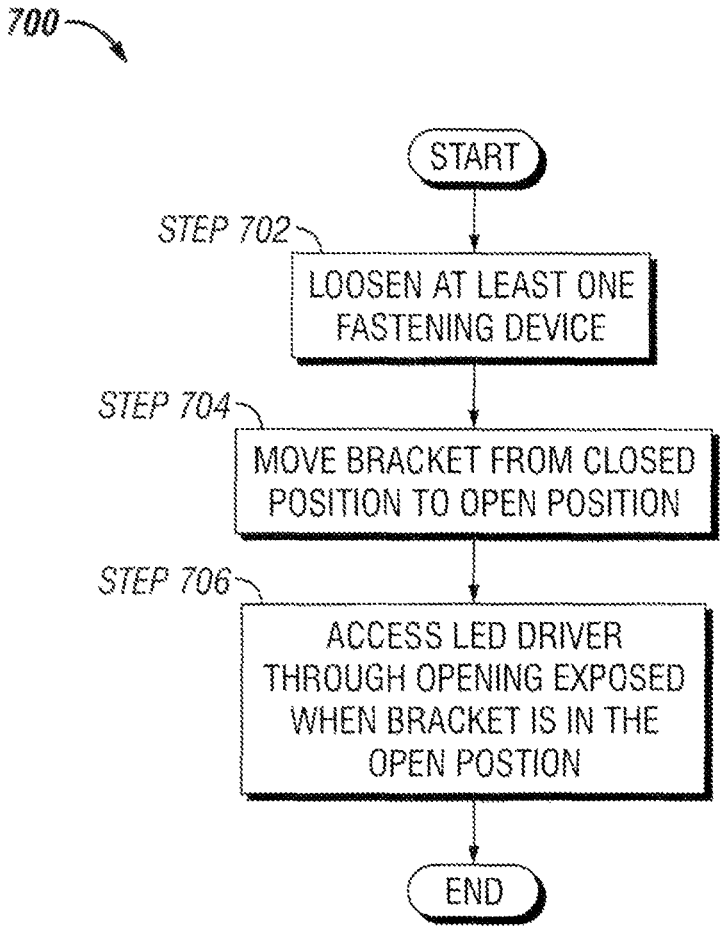
FIG. 7 shows a flowchart diagram of a method for accessing a LED driver within a LED driver housing in accordance with certain example embodiments.

FIG. 7 is a flowchart presenting an example method 700 for accessing a LED driver within a LED driver housing in accordance with one example embodiment. While the various steps in this flowchart are presented and described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order. In addition, a person of ordinary skill in the art will appreciate that additional steps not shown in FIG. 7, may be included in performing this method. Accordingly, the specific arrangement of steps should not be construed as limiting the scope.

Referring now to FIGS. 1-7, the example method 700 begins at the START step and proceeds to step 702, where at least one fastening device (e.g., fastening device 628) of a number of fastening devices is loosened. In certain example embodiments, each of the fastening devices traverses a bracket (e.g., bracket 122, bracket 622) and is mechanically coupled to the frame 116. The frame 116 can be coupled to the LED driver housing 114 and can be positioned over an opening 177 in the LED driver housing 114. When the at least one fastening device is loosened, then the fastening device can become decoupled from the frame 116 or remain coupled to the frame 116.

In step 704, the bracket (e.g., bracket 122, bracket 622) is moved from a closed position to an open position. By moving the bracket from the closed position to the open position, the opening 177 in the LED driver housing 114 is exposed. In certain example embodiments, moving the bracket can include sliding a first extension (e.g., extension 670) of the bracket 622 using a slot 624 in the first extension 670. In such a case, the at least one fastening device (e.g., fastening device 625) can traverse the slot.

In addition, or in the alternative, moving the bracket can include rotating, using a hinge coupled to the first extension 670 of the bracket 622 and a second extension 672 of the bracket 622, the first extension 670 relative to the second extension 672. In some cases, the method 700 can also include decoupling, prior to moving the bracket 622, an additional fastening device 628 from the frame 116, where the additional fastening device 628 is coupled to an extension 674 of the bracket 622.

In step 706, the LED driver 112 is accessed through the opening 177 exposed when the bracket 622 is in the open position. In such a case, the wires (e.g., wire 131, wire 132) can remain coupled to the LED driver 112 and to the remainder 150 of the LED lighting fixture 100 while the bracket 62 is in the open position.

Accessing LED drivers in LED lighting fixtures using example embodiments allows a user to maintain, repair, and/or replace a LED driver housed within a LED driver housing without disassembling and/or unwiring the LED lighting fixture. By using certain example embodiments, a single person can move a bracket mechanically coupled to wiring for the LED lighting fixture to allow access to the LED driver in the LED driver housing. As a result, a LED driver can be accessed without any rewiring, drilling new holes, repairing a surface or wall, hiring an electrician, buying an entirely new fixture, and/or encountering other problems that can arise when trying to access a LED driver within a LED driver housing. Using example embodiments described herein, the LED driver can be more easily maintained, repaired, and/or replaced at some point in the future.

Further, using cabling systems for LED lighting fixtures described herein allows a LED lighting fixture to be classified as a Class 2 wiring device, which means that the LED lighting fixture can be installed and maintained without a licensed electrician. Further, example cabling systems for LED lighting fixtures described herein operate at lower voltages, consuming less energy and saving more money for the user. Further, the example cabling systems have a more appealing appearance than traditional handing LED lighting fixtures, where the cables from which the fixture hangs are of different sizes and, in some cases, colors. In addition, the example cabling systems provide the opportunity to create modular connections of LED lighting fixtures. Example cabling systems also include safety features that physically separate electrical conductors, reducing the risk of a fault or other adverse electrical condition.

Accordingly, many modifications and other embodiments set forth herein will come to mind to one skilled in the art to which accessing LED drivers in LED lighting fixtures and cabling systems for LED lighting fixtures pertain having the benefit of the teachings presented in the foregoing descriptions and the associated drawings. Therefore, it is to be understood that accessing LED drivers in LED lighting fixtures and cabling systems for LED lighting fixtures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A light emitting diode (LED) lighting fixture, comprising:

a LED driver housing comprising an opening;

a LED driver positioned within the LED driver housing;

a mounting assembly comprising:

a frame removably coupled to the LED driver housing around the opening; and a bracket movably coupled to the frame and positioned over the opening, wherein the bracket comprises a plurality of fastening devices that, when loosened, allow the bracket to move from a closed position to an open position, wherein more of the opening is exposed when the bracket is in the open position than when the bracket is in the closed position.

2. The LED lighting fixture of claim 1, further comprising:

a coupling feature disposed in a central aperture of the bracket, wherein the central bracket is mechanically coupled to the bracket when the bracket is in the open position and in the closed position.

3. The LED lighting fixture of claim 2, further comprising:

at least one wire that traverses the coupling feature and comprises a first end and a second end, wherein the first end of the at least one wire is coupled to the LED driver, and wherein the second end of the at least one wire is coupled to at least one LED.

4. The LED lighting fixture of claim 3, wherein the at least one wire remains coupled to the LED driver and the at least one LED when the bracket is in the closed position and when the bracket is in the open position.

5. The LED lighting fixture of claim 1, wherein the bracket comprises a plurality of extensions, wherein at least one of the plurality of extensions has a slot along which a fastening device slides when the bracket moves from the open position to the closed position, wherein the fastening device is coupled to the frame.

6. The LED lighting fixture of claim 5, wherein the plurality of extensions are movably coupled to each other using detents.

7. The LED lighting fixture of claim 5, wherein the plurality of extensions are movably coupled to each other using a hinge.

8. A method for accessing a light emitting diode (LED) driver within a LED driver housing, the method comprising:

loosening at least one fastening device of a plurality of fastening devices, wherein each of the plurality of fastening devices traverses a bracket and is mechanically coupled to the frame, wherein the frame is coupled to the LED driver housing and is positioned over an opening in the LED driver housing;

moving the bracket from a closed position to an open position; and accessing the LED driver through the opening exposed when the bracket is in the open position.

9. The method of claim 8, wherein moving the bracket comprises sliding a first extension of the bracket using a slot in the first extension, wherein the at least one fastening device traverses the slot.

10. The method of claim 9, wherein moving the bracket further comprises rotating, using a hinge coupled to the first extension of the bracket and a second extension of the bracket, the first extension relative to the second extension.

11. The method of claim 8, further comprising:

decoupling, prior to moving the bracket, an additional fastening device of a plurality of fastening devices from the frame, wherein the additional fastening device is coupled to an extension of the bracket.

12. A cabling system for a light emitting diode (LED) lighting fixture, comprising:

a LED driver housing;

a LED driver disposed within the LED driver housing;

a first wire comprising a first conductor carrying a positive power component from the LED driver, wherein the first wire is electrically coupled to the LED driver;

a second wire comprising a second conductor carrying a negative power component from the LED driver, wherein the second wire is electrically coupled to the LED driver;

a remainder of the LED lighting fixture that is electrically coupled to the first wire and the second wire, wherein the remainder comprises at least one LED that operates using the positive power component carried by the first wire and the negative power component carried by the second wire; and a first coupling feature positioned between the LED driver housing and the remainder of the LED lighting fixture, wherein the first coupling feature is mechanically coupled to the first wire and the second wire, wherein the first coupling feature maintains a physical separation between the first wire and the second wire.

13. The cabling system of claim 12, wherein the first coupling feature comprises a plurality of apertures that traverse therethrough, wherein the first wire traverses one of the plurality of apertures, and wherein the second wire traverses another of the plurality of apertures.

14. The cabling system of claim 13, wherein at least a portion of the first wire disposed within the one of the plurality of apertures is a bare conductor without insulation.

15. The cabling system of claim 12, further comprising:

a second coupling feature positioned between the LED driver housing and the remainder of the LED lighting fixture, wherein the second coupling feature is mechanically coupled to the first wire and the second wire, wherein the second coupling feature maintains the physical separation between the first wire and the second wire.

16. The cabling system of claim 15, further comprising:

at least one wire separating clip mechanically coupled to the first wire and the second wire, wherein the at least one wire separating clip is positioned between the first coupling feature and the second coupling feature and maintains the physical separation between the first wire and the second wire.

17. The cabling system of claim 16, wherein at least one wire separating clip can be moved by sliding along the first wire and the second wire.

18. The cabling system of claim 16, wherein at least one wire separating clip couples to the first wire and the second wire using at least one snap fitting.

19. The cabling system of claim 12, further comprising:

an insulator disposed inside the first coupling feature, wherein the insulator is made of an electrically insulating material and electrically isolates the first wire from the second wire.

20. The cabling system of claim 12, wherein first coupling feature comprise a plurality of portions that couple to each other and a bracket that is mechanically coupled to the LED driver housing.

* * * * *